US008783781B1

(12) United States Patent
McClure et al.

(10) Patent No.: US 8,783,781 B1
(45) Date of Patent: Jul. 22, 2014

(54) INFLATABLE RECLINING CHAIR

(76) Inventors: Pamela McClure, Brackettville, TX (US); Tanya K. McClure, Spofford, TX (US)

( * ) Notice: Subject to any disclaimer, the term of this patent is extended or adjusted under 35 U.S.C. 154(b) by 155 days.

(21) Appl. No.: 13/364,648

(22) Filed: Feb. 2, 2012

(51) Int. Cl.
*A47C 4/54* (2006.01)

(52) U.S. Cl.
USPC ..... 297/452.41; 297/DIG. 3

(58) Field of Classification Search
USPC ..... 297/452.41, 330, DIG. 3, DIG. 10
See application file for complete search history.

(56) References Cited

U.S. PATENT DOCUMENTS

| | | | | | |
|---|---|---|---|---|---|
| 2,612,645 | A | * | 10/1952 | Boland | 5/644 |
| 3,408,107 | A | | 10/1968 | Savage | |
| 3,572,836 | A | | 3/1971 | Khanh | |
| 3,712,674 | A | | 1/1973 | Ando | |
| 3,978,530 | A | | 9/1976 | Amarantos | |
| 4,619,481 | A | | 10/1986 | Grudzinskas | |
| 5,364,161 | A | | 11/1994 | Liu | |
| 5,516,188 | A | * | 5/1996 | Bruhnke et al. | 297/129 |
| D371,252 | S | | 7/1996 | Chaput | |
| D378,169 | S | | 2/1997 | Yu | |
| 5,660,438 | A | | 8/1997 | Tedesco | |
| 5,713,631 | A | * | 2/1998 | O'Neill et al. | 297/284.6 |
| D391,774 | S | | 3/1998 | Yu | |
| D395,556 | S | | 6/1998 | Lieberman | |
| D407,230 | S | | 3/1999 | Lieberman | |
| 5,951,111 | A | | 9/1999 | Klimenko | |
| 6,042,186 | A | | 3/2000 | Kojic et al. | |
| D424,314 | S | | 5/2000 | Linder | |
| 6,089,668 | A | | 7/2000 | Peterson | |
| 6,161,902 | A | | 12/2000 | Lieberman | |
| D446,030 | S | | 8/2001 | Linder | |
| 6,328,385 | B1 | | 12/2001 | Lau | |
| 6,786,555 | B2 | * | 9/2004 | Brook | 297/452.41 |
| 7,350,864 | B1 | | 4/2008 | Brewster | |
| 7,360,266 | B2 | * | 4/2008 | Kasatshko | 5/722 |
| 2003/0038517 | A1 | * | 2/2003 | Moran et al. | 297/284.3 |
| 2008/0007103 | A1 | * | 1/2008 | Welles et al. | 297/330 |
| 2009/0189432 | A1 | | 7/2009 | Anikin | |

* cited by examiner

*Primary Examiner* — David R Dunn
*Assistant Examiner* — Alexander Harrison
(74) *Attorney, Agent, or Firm* — Robert C. Montgomery; Montgomery Patent & Design

(57) ABSTRACT

An inflatable reclining chair which provides therapeutic support while in a seated or lying position is capable of being inflated by an air compressor and a valve assembly. The recliner may be placed upon a floor or ground surface and includes conventional chair features such as armrests, a back rest, and a head rest to allow the user to relax in comfort while in a reclined state. The device further includes an inflatable footrest and an internal recline air bladder which allows a user to select a desired back rest angle. In this manner, the user may select a variety of resting configurations. Finally, the recliner may be deflated completely and stored in a carrying case along with the air compressor, for convenient transportation.

11 Claims, 7 Drawing Sheets

INFLATABLE RECLINING CHAIR

RELATED APPLICATIONS

There are no current co-pending applications related to the current application.

FIELD OF THE INVENTION

The present invention relates generally to a portable chair, and in particular, to a portable inflatable chair.

BACKGROUND OF THE INVENTION

Many people suffering from sleep apnea and other ailments such as back pain, neck pain, and the like find that sleeping on a conventional mattress is nearly impossible. Many of these sufferers find that the common recliner provides for the most restful night's sleep. While a recliner is commonly available in residential home areas, they are not so common while traveling. Thus, users who may be visiting in another home, sleeping in a hotel, or even camping, find that getting a good night's sleep is not possible.

A variety of portable chairs exist, from folding style chairs to benches to stools. However, portable chairs generally are constructed to be lightweight, small in volume, and easily collapsible, and thus do not provide the padding and comfort afforded by larger, less portable recliners and similar furniture.

Another apparatus for providing readily portable seating but while affording a fully-sized chair at the desired location of use is the inflatable chair.

Various attempts have been made to provide inflatable furniture. Examples of these attempts can be seen by reference to several U.S. patents, including U.S. Pat. No. 3,408,107; U.S. Pat. No. 3,572,836; U.S. Pat. No. 3,978,530; U.S. Pat. No. 5,364,161; U.S. Pat. No. 5,660,438; U.S. Pat. No. 6,042,186; U.S. Pat. No. 6,161,902; and U.S. Pat. No. 7,350,864.

Additionally, ornamental designs for an inflatable chair exist, particularly U.S. Pat. Nos. D 378,169; D 395,556; D 407,230; D 424,314; and D 446,030. However, none of these designs are similar to the present invention.

While these apparatuses fulfill their respective, particular objectives, each of these references suffer from one (1) or more disadvantages. Many such apparatuses are not able to provide adjustable features to a user, unlike conventional recliners or similar furniture which provides a range of adjustable features and positions. Furthermore, many such apparatuses are time consuming or difficult to operate and adjust during use. Also, many such apparatuses are not particularly convenient for users who need the apparatuses for purposes of transportable sleep due to medical conditions. In addition, many such apparatuses can be difficult and bulky to transport. Accordingly, there exists a need for a portable chair providing a range of adjustability and features and without the disadvantages as described above. The development of the present invention substantially departs from the conventional solutions and in doing so fulfills this need.

SUMMARY OF THE INVENTION

In view of the foregoing references, the inventor recognized the aforementioned inherent problems and observed that there is a need for an inflatable chair particularly adapted for comfortable sleeping in remote locations which accommodates users with regards to medical needs, convenience, and customizability. Thus, the object of the present invention is to solve the aforementioned disadvantages and provide for this need.

To achieve the above objectives, it is an object of the present invention to provide a hollow inflatable chair assembly comprised of an assembly of vinyl panels providing the ability to transport the apparatus in a compact, collapsed state while enabling inflation for full-sized functionality at a desired location. The apparatus includes a seat, a back rest, a head rest, a foot rest, a first arm rest, and a second arm rest.

Another object of the present invention is to enable quick and easy coincidental inflation of the seat, backrest, and arm rests using an air compressor. The air compressor is an electrical air compressor attachable to a valve module of the apparatus via an air supply hose.

Yet still another object of the present invention is to provide a separate air port for the footrest such that the foot rest can be inflated and deflated independently from the seat based upon a user's preference.

Yet still another object of the present invention is to provide an adjustable angle to the back rest via a wedge-shaped recline bladder disposed within the back rest. The bladder can be inflated and deflated independently from the back rest and as such can selectively vary the angle of the back rest between a horizontal and a vertical position.

Yet still another object of the present invention is to comprise the first arm rest of a shortened length facilitating ingress to and egress from the chair as well as ease of access to a control panel mounted on a side of the chair assembly.

Yet still another object of the present invention is to enable manual control of the chair assembly, foot rest, and bladder during use via a plurality of buttons located on the control panel. Each of the chair assembly, foot rest, and bladder can be selectively and independently inflated or deflated by a desired amount by activating a corresponding button.

Yet still another object of the present invention is to provide a remote control in wireless communication with the control panel for selectively inflating or deflating the chair assembly, foot rest, and bladder without having to access the control panel.

Yet still another object of the present invention is to provide a storage pouch along a front of the seat for storing the foot rest during periods of non-use.

Yet still another object of the present invention is to provide a carrying case for ease of storage and transportation for the entire apparatus.

Yet still another object of the present invention is to provide a method of utilizing the device that provides a unique means of procuring a model of the apparatus 10 having a desired size and appearance, transporting the apparatus to a desired destination, connecting the air compressor to a power supply, using the control panel to fill the chair assembly, using the control panel to inflate the foot rest, using the control panel to inflate the internal bladder to obtain a desired reclining angle of the back rest, using the control panel as needed to allow a portion of compressed air to be exhausted until obtaining a desired firmness or a desired reclined angle, sitting or laying upon the chair assembly, utilizing the apparatus for rest, sleep, or lounging, in a normal manner, deflating the apparatus, and inserting the rolled-up chair assembly and air compressor into the carrying case for transportation and storage.

Further objects and advantages of the present invention will become apparent from a consideration of the drawings and ensuing description.

BRIEF DESCRIPTION OF THE DRAWINGS

The advantages and features of the present disclosure will become better understood with reference to the following more detailed description and claims taken in conjunction with the accompanying drawings, in which like elements are identified with like symbols, and in which:

DETAILED DESCRIPTION OF THE PREFERRED EMBODIMENT

Figure 1:
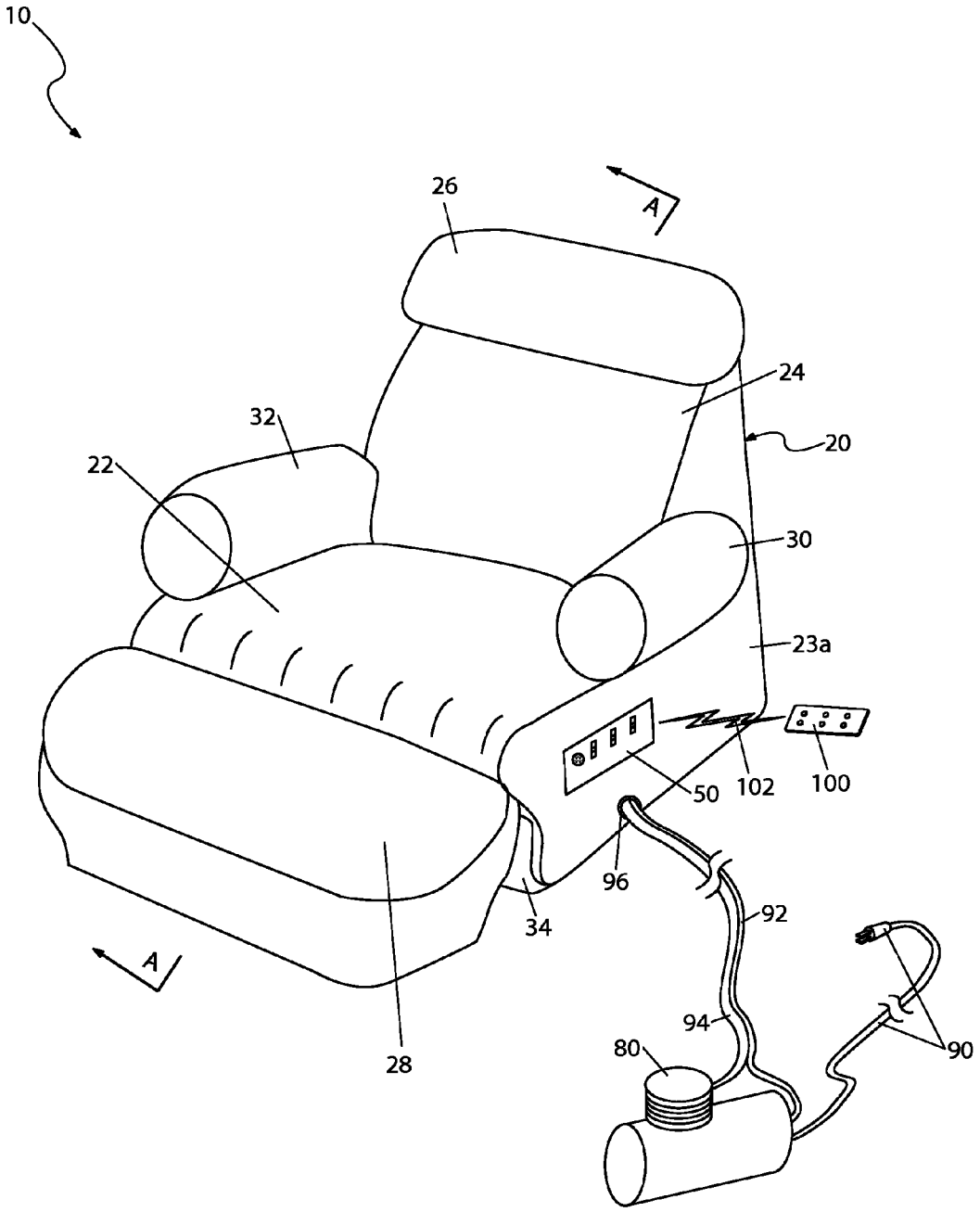
FIG. 1 is a perspective view of an inflatable reclining chair 10, according to a preferred embodiment of the present invention.

| DESCRIPTIVE KEY | |
|---|---|
| 10 | inflatable reclining chair |
| 20 | chair assembly |
| 22 | seat |
| 23a | first side panel |
| 23b | second side panel |
| 24 | back rest |
| 26 | head rest |
| 28 | foot rest |
| 30 | first arm rest |
| 32 | second arm rest |
| 34 | storage pouch |
| 36 | recline bladder |
| 38 | air distribution hose |
| 40 | air port |
| 50 | control panel |
| 52 | face plate |
| 54 | recline switch |
| 56 | chair inflate switch |
| 58 | foot rest inflate switch |
| 60 | vent exhaust |
| 61 | vent hose |
| 62 | valve module |
| 64 | manifold |
| 65 | compressor start circuit |
| 66 | foot rest valve |
| 68 | chair valve |
| 70 | recline valve |
| 72 | RF receiver |
| 80 | air compressor |
| 90 | power cord |
| 92 | electrical supply cord |
| 94 | air supply hose |
| 96 | grommet |
| 100 | remote controller |
| 102 | RF signal |
| 104 | remote control button |
| 110 | user |
| 120 | carrying case |
| 122 | body |
| 124 | first strap |

-continued

| DESCRIPTIVE KEY | |
|---|---|
| 126 | second strap |
| 128 | zipper |
| 130 | zipper puller |

In accordance with the invention, the best mode is presented in terms of a preferred embodiment, herein depicted within FIGS. 1 through 6. However, the disclosure is not limited to a single described embodiment and a person skilled in the art will appreciate that many other embodiments are possible without deviating from the basic concept of the disclosure and that any such work around will also fall under its scope. It is envisioned that other styles and configurations can be easily incorporated into the teachings of the present disclosure, and only one particular configuration may be shown and described for purposes of clarity and disclosure and not by way of limitation of scope.

The terms "a" and "an" herein do not denote a limitation of quantity, but rather denote the presence of at least one of the referenced items.

The present invention describes an inflatable reclining chair (herein described as the "apparatus") 10, which is capable of being inflated by a user 110 using an air compressor 80. The apparatus 10 is intended to sit upon a floor or ground surface and provides selective inflation of chair 22 and foot rest 28 portions as well as providing a selectable reclined angle of a back rest portion 24. The apparatus 10 is to be rolled up and concealed in a carrying case 120, thereby being particularly useful while traveling to locations where recliners are typically not present. It would also be useful at sporting events, camping, tailgate parties and other instances where conventional portable chairs are used.

Referring now to FIG. 1, a perspective view of the apparatus 10, according to a preferred embodiment of the present invention, is disclosed. The apparatus 10 provides a chair assembly 20 comprising a hollow inflatable structure envisioned to be made of a flexible vinyl material and comprising an assembly of vinyl panels being permanently joined along internal and external seams to form a plurality of inflatable features including a seat 22, a first side panel 23*a*, a second side panel 23*b*, a back rest 24, a head rest 26, a foot rest 28, a first arm rest 30, and a second arm rest 32. It is envisioned that the chair assembly 20 comprise an exterior high-friction surface using a microfiber or velvet-like process and introduced in a variety of colors and patterns to match existing decors. It is understood that the manufacturing of the chair assembly 20 is to be accomplished using common plastic joining processes such as plastic welding, adhesive bonding, and the like. The chair assembly 20 is depicted here taking on a form of a conventional recliner; however, it is further understood that the apparatus 10 may be introduced in various forms having various proportions, overall sizes, and likenesses to popular chair styles without deviating from the teachings of the invention, and as such should not be interpreted as a limiting factor of the apparatus 10.

Figure 2A:
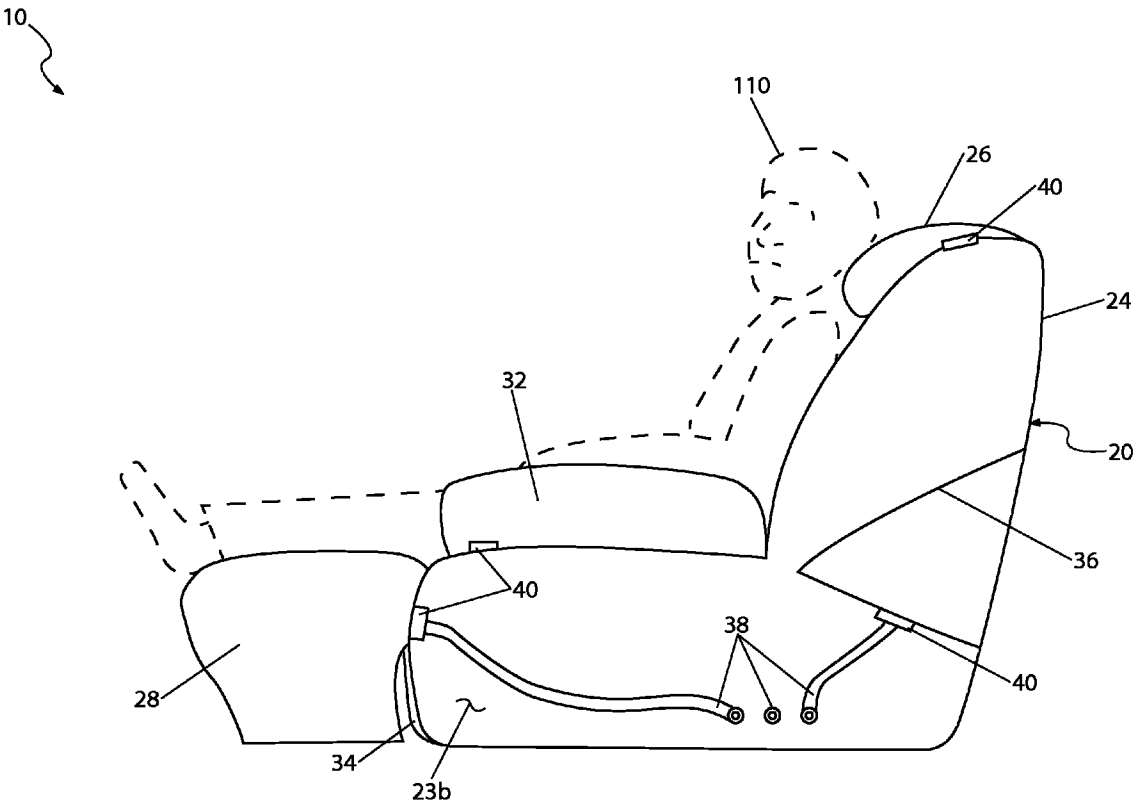
FIG. 2*a* is a section view of the inflatable reclining chair 10 taken along section line A-A (see FIG. 1) depicting an inflated state, according to a preferred embodiment of the present invention.
Figure 2B:
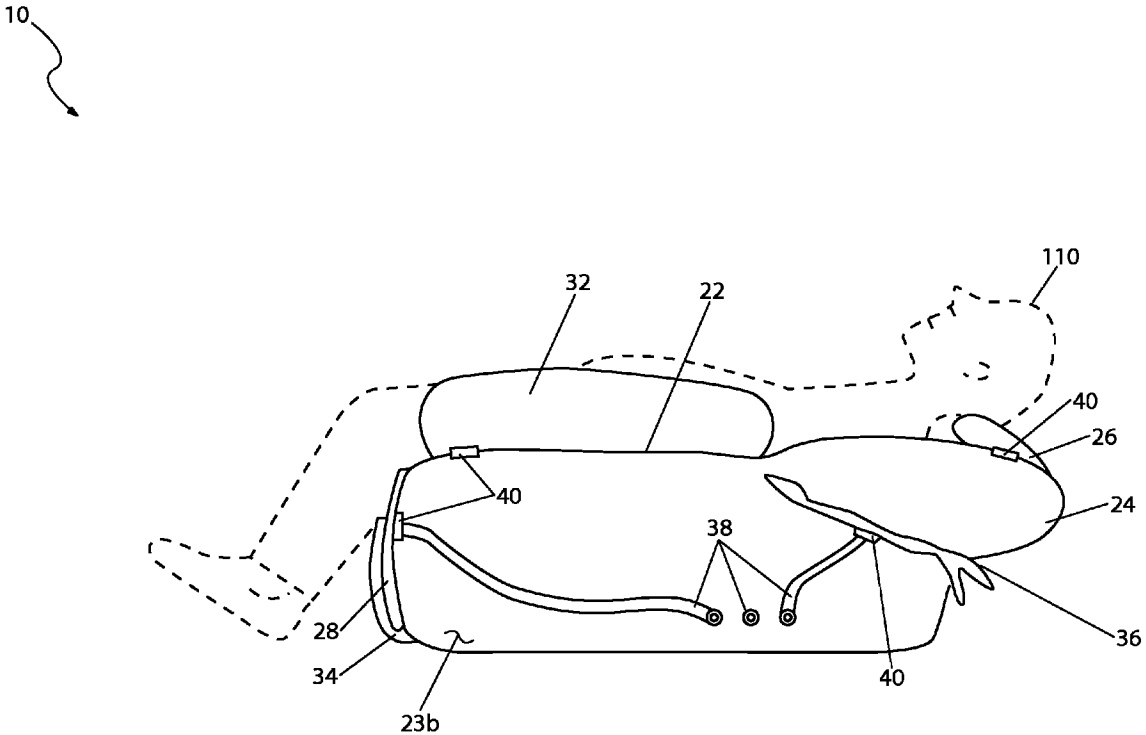
FIG. 2*b* is another section view of the inflatable reclining chair 10 taken along section line A-A (see FIG. 1) depicting a partially deflated state, according to a preferred embodiment of the present invention.

The apparatus 10 provides coincidental inflation of the main seat 22, backrest 24, and arm rest 30, 32 portions of the chair assembly 20 being in pneumatic communication with each other via a plurality of air ports 40 (see FIGS. 2*a* and 2*b*). The apparatus 10 further provides isolation of, and independent inflation and deflation of the foot rest portion 28 and an internal recline bladder 36, thereby allowing the user 110 to configure a sitting, reclined, or laying profile based upon a user's 110 preference (see FIGS. 2*a* and 2*b*). The first arm rest 30 provides a shortened horizontal length when compared to the normal full-length second arm rest 32. The shorter first arm rest 30 allows a user 110 to easily enter and exit the chair assembly 20 when approaching along the first side panel 23*a*.

The apparatus 10 further comprises an air compressor 80 which provides a supply of compressed air to inflate said chair assembly 20. The air compressor 80 is envisioned to comprise a small commercially-available low-pressure vibration or piston-type unit being powered by an available 120-volt outlet via a power cord 90 in a conventional manner. The air compressor 80 is in electrical and pneumatic communication with a valve module 62 located within the chair assembly 20 via a respective electrical supply cord 92 and an air supply hose 94 which enter the chair assembly 20 through the first side panel 23*a* via a sealed rubber or vinyl grommet 96 to prevent air leakage.

The apparatus 10 also provides a user 110 with convenient control of the inflation/deflation process via a permanently-mounted control panel 50 located upon a first side panel portion 23*a* of the chair assembly 20. Additionally, said inflation and deflation of the chair assembly 20 may be accomplished using a hand-held remote controller 100 in like manner.

Referring now to FIGS. 2*a* and 2*b*, section views of the apparatus 10 depicting inflated and partially deflated states, according to a preferred embodiment of the present invention, are disclosed. The apparatus 10 provides internal isolation of three (3) portions of the chair assembly 20 being the foot rest 28, the recline bladder 36, and the pneumatically-joined remaining portions of the chair assembly 20, being the seat 22, back rest 24, head rest 26, and arm 30, 32 portions. The chair assembly 20 comprises a pair of air distribution hoses 38 which provide specific internal compressed air conveyance to said foot rest 28 and recline bladder 36 portions. The apparatus 10 allows a user 110 an ability to produce a number of configurations of the chair assembly 20 by directing a desired amount of air into the three (3) aforementioned chambers of the chair assembly 20 to produce a desired firmness. The chair assembly 20 may be configured, for example, from a fully inflated and slightly reclined state as seen in FIG. 2*a*, to a fully reclined and horizontal configuration as seen in FIG. 2*b*, as well as any reclined angle in between. Additionally, the foot rest portion 28 may be selectively inflated from a fully inflated form, or may be incrementally deflated to a desired height and firmness based upon a user's 110 preference. The chair assembly 20 comprises a storage pouch 34 being integrated into a forward-facing surface of the seat portion 22, thereby providing a containment means to the foot rest portion 28 when completely deflated as seen in FIG. 2*b*.

Figure 4:
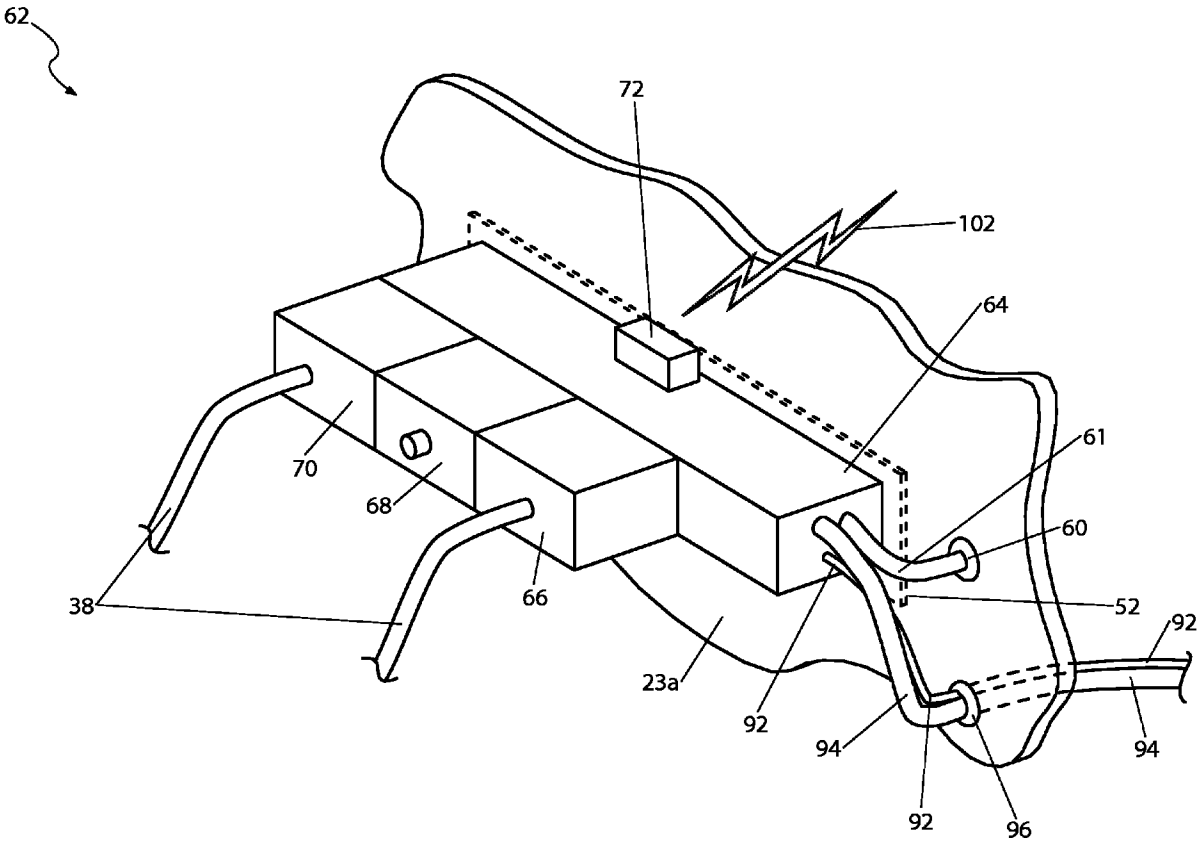
FIG. 4 is a perspective view of a valve module portion 62 of the inflatable reclining chair 10, according to a preferred embodiment of the present invention.

The apparatus 10 provides an internal means to distribute compressed air including the air distribution hoses 38 which convey a flow of compressed air from an internal valve module 62 to the aforementioned foot rest 28 and recline bladder 36 (see FIG. 4). Furthermore, a plurality of air ports 40 are integrated along an interior wall portion of the chair assembly 20 to enable a flow of air to freely pass between seat 22, back rest 24, head rest 26, and arm 30, 32 portions as well as from the aforementioned air distribution hoses 38 and the foot rest 28 and recline bladder 36 portions. Said air ports 40 are envisioned to comprise donut-shaped apertures being sealed along said wall portions of the chair assembly 20 using methods such as plastic welding, adhesive bonding, and the like.

Figure 3:
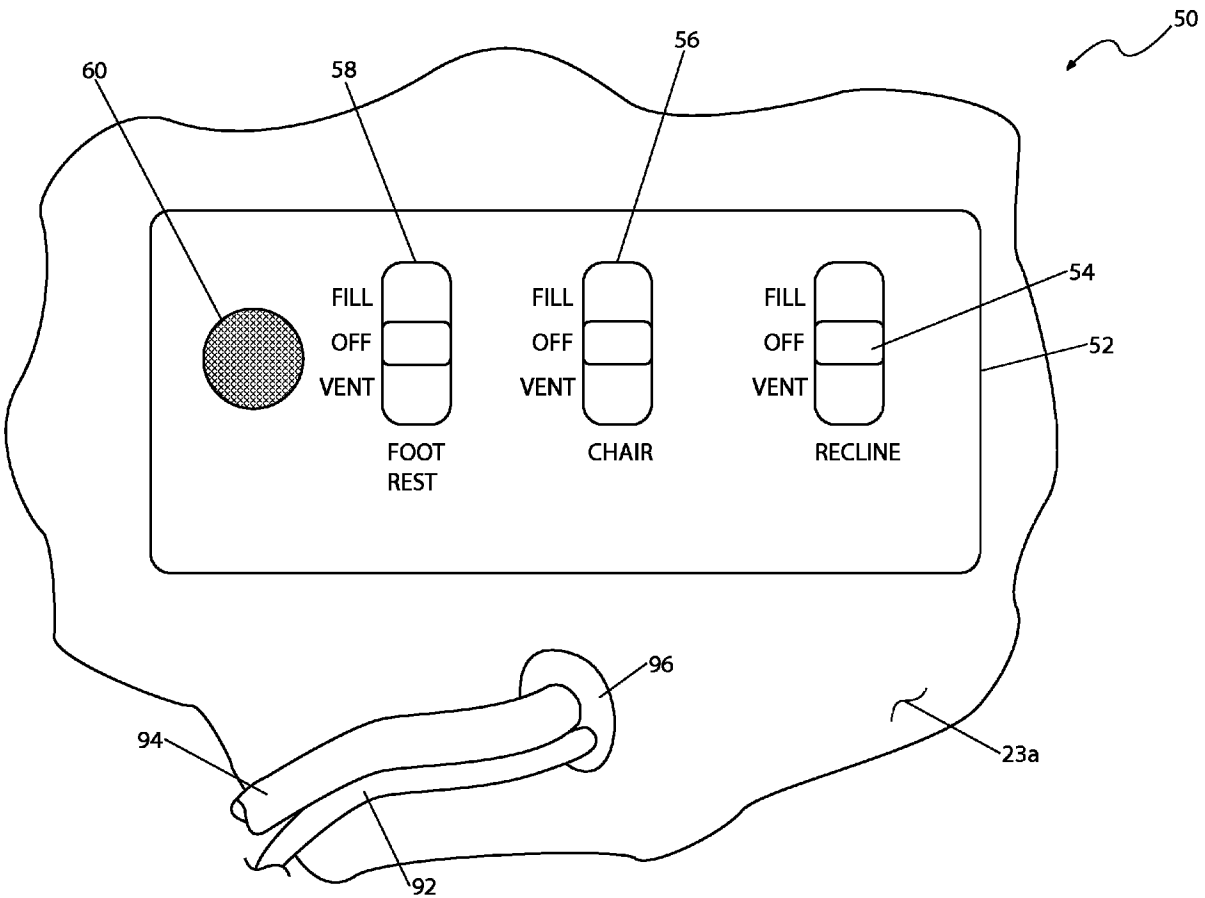
FIG. 3 is a front view of a control panel portion 50 of the reclining chair 10, according to a preferred embodiment of the present invention.

Referring now to FIGS. 3 and 4, views of control panel 50 and valve module 62 portions of the apparatus 10, according to a preferred embodiment of the present invention, are disclosed. The apparatus 10 provides convenient means for a user 110 to control the process of selectively inflating and deflating the three (3) separated chambers of the chair assembly 20 via a control panel 50 being conveniently positioned along a first side panel portion 23*a* of the chair assembly 20. Said control panel 50 works in conjunction with the valve module 62 being mounted along a rear interior surface of said control panel 50, being located within said chair assembly 20. The control panel 50 and valve module 62 provide a user 110 a means to individually inflate or deflate the foot rest 28, the recline bladder 36, and the remaining pneumatically joined portions of the chair assembly 20. The control panel 50 comprises an attractive face plate 52 which provides a mounting means to a recline switch 54, a chair inflate switch 56, a foot rest inflate switch 58, and a vent exhaust 60. Said vent exhaust 60 allows escape of air being exhausted from chambers during deflation. The switches 54, 56, 58 comprise common three-position toggle switch units which provide a spring-loaded center return function. Each switch 54, 56, 58 provides inflating and deflating functions via upward "FILL", center "OFF", and downward "VENT" positions to initiate the respective functions for a particular selected chamber of the chair assembly 20. Furthermore, upon pushing any switch 54, 56, 58 to the "FILL" position, the air compressor 80 automatically starts to supply a flow of compressed air into the selected chamber of the chair assembly 20 (see FIG. 6).

The valve module 62 is envisioned to comprise a commercially-available integrated pneumatic valve bank assembly being specifically configured for the apparatus 10 further comprising an electrical and pneumatic distribution manifold 64, a double-solenoid foot rest valve 66, a double-solenoid chair valve 68, a double-solenoid recline valve 70, and a RF receiver module 72. The RF receiver module 72 provides the user 110 with redundant operable functionality of the valve module 62 via a hand-held remote controller 100 which transmits an RF signal 102 to said RF receiver module 72 within the chair assembly 20, thereby controlling all previously described inflation and deflation process functions of the apparatus 10. The remote controller 100 comprises a plurality of integral push button portions 104 along a top surface which provide duplicate functionality as the previously described recline switch 54, chair inflate switch 56, and foot rest inflate switch 58.

The valve module 62 is in electrical and pneumatic communication with the air compressor 80 via a respective electrical supply cord 92 and an air supply hose 94. As previously described, initiating any "FILL" command upon the control panel 50 or the remote controller 100, will automatically start the air compressor 80 and deliver a supply of compressed air to the valve module 62, and subsequently into the chair assembly 20.

Figure 5:
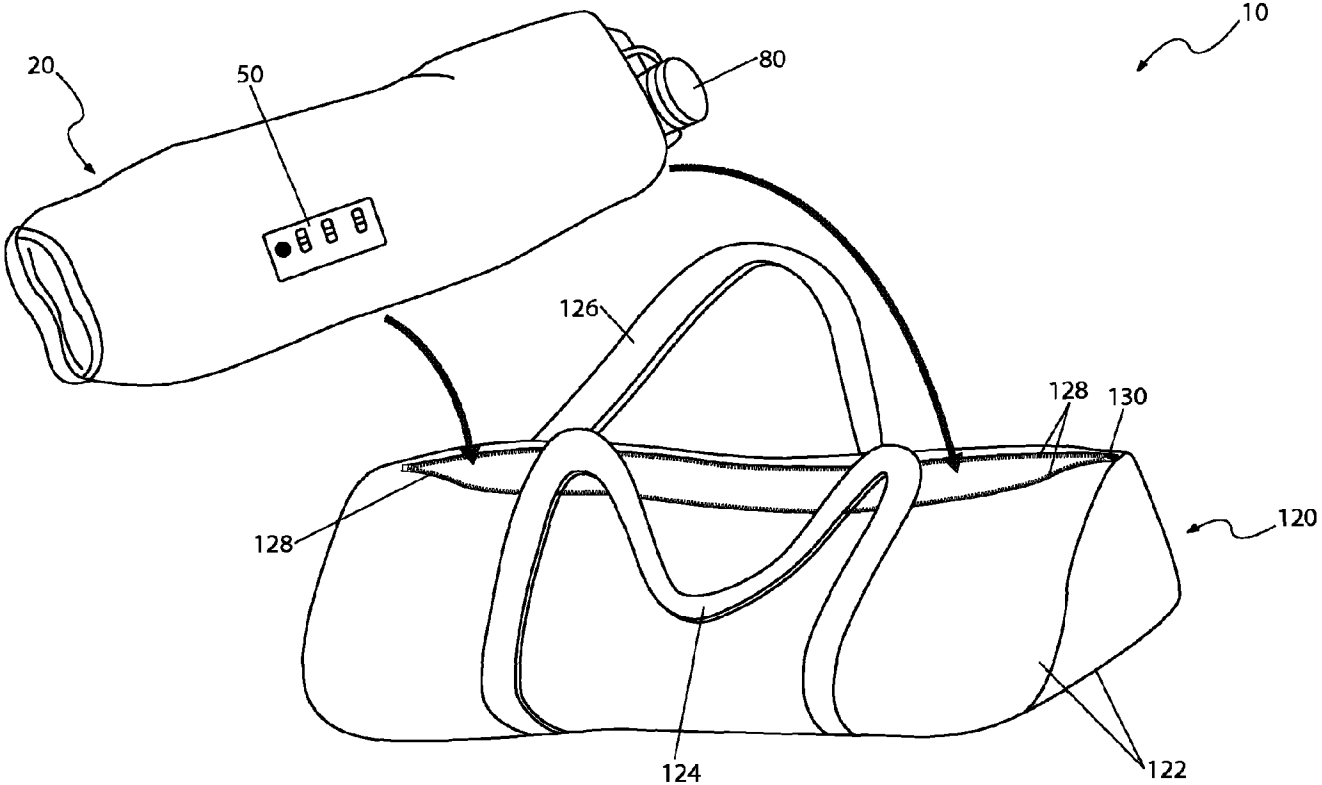
FIG. 5 is a perspective view of a carrying case portion 120 of the inflatable reclining chair 10, according to a preferred embodiment of the present invention; and, FIG. 6 is an electrical diagram of the inflatable reclining chair 10, according to a preferred embodiment of the present invention.

Referring now to FIG. 5, a perspective view of a carrying case portion 120 of the apparatus 10, according to a preferred embodiment of the present invention, is disclosed. The apparatus 10 provides a means of convenient transportation to various destinations via containment within a carrying case 120, thereby allowing a user 110 to compactly store or move the apparatus 10. The carrying case 120 is envisioned to comprise an elongated body portion 122 resembling a cylindrical duffle bag and being made using a durable water-resistant material such as canvas, vinyl, or the like. The carrying case 120 further comprises features such as, but not limited to: a first strap 124, a second strap 126, and a longitudinal zipper 128 having a standard zipper puller portion 130. It is further envisioned that the chair assembly 20 would be rolled up into a compact form, and along with the compressor, be inserted into said carrying case 120 for transportation.

Figure 6:
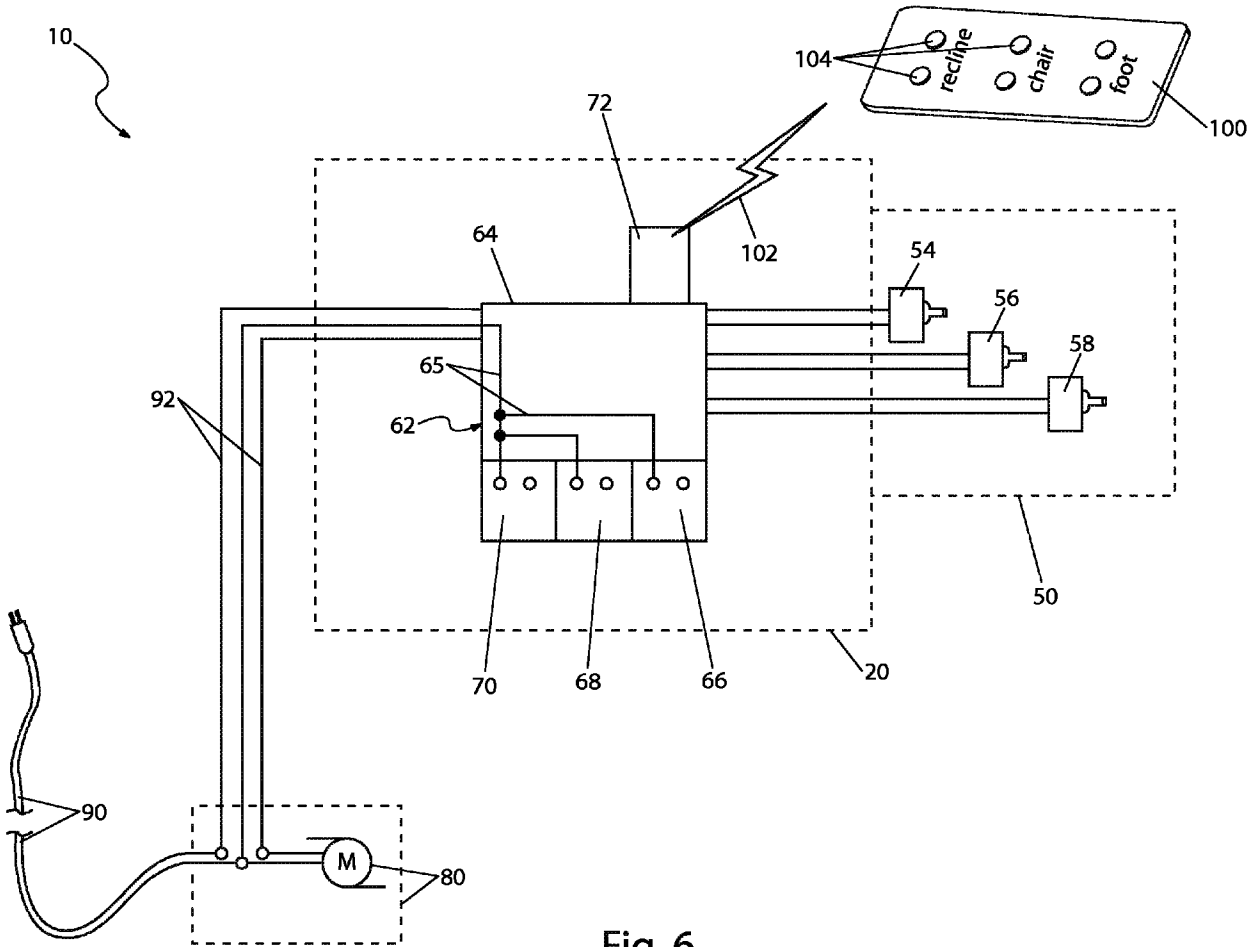

Referring now to FIG. 6, an electrical diagram of the apparatus 10, according to a preferred embodiment of the present invention, is disclosed. Electrical power is supplied to the apparatus 10 from a conventional 120-volt wall outlet and is subsequently distributed to the valve module 62 and the air compressor 80 portions. A compressor start circuit 65 is integrated into said valve module 62 which provides power to the air compressor 80 upon user 110 selection of a "FILL" command using the toggle switches 54, 56, 58 or corresponding remote control button portions 104 of the remote controller 100. The valve module 62 is to be configured with three (3) common double-solenoid valves which provide a spring-return center position to isolate the contained compressed air within the chair assembly 20, as well as providing powered "FILL" and "VENT" valving functionality as previously described.

The "FILL" and "VENT" functions of the apparatus 10 may also be activated in a redundant fashion via the remote controller 100 which is capable of transmitting an RF signal 102 in a wireless manner to the RF receiver 72 portion of the valve module 62. Said RF receiver 72 is envisioned to comprise integrated circuitry which provides signal modulation as well as solid-state output relays to direct a current to a particular solenoid valve 66, 68, 70 based upon a user 110 selected "FILL" or "VENT" function. The remote controller 100 is envisioned to comprise a standard battery-operated unit having an elongated plastic enclosure portion which provides digit actuation of a plurality of push buttons 104 in a conventional manner. Said push buttons 104 are to duplicate corresponding "FILL" and "VENT" functions of the aforementioned toggle switches 54, 56, 58.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be installed and utilized as indicated in FIGS. 1, 2*a*, and 2*b*.

The method of installing the apparatus 10 may be achieved by performing the following steps: procuring a model of the apparatus 10 having a desired style, size, and exterior color/pattern; transporting the apparatus 10 to a desired destination such as a visited home, a hotel, when camping, or the like, using the carrying case 120; removing the chair assembly 20 and air compressor 80 from the carrying case 120; unrolling and placing a bottom portion of the chair assembly 20 upon a ground or floor surface; and, connecting the power cord 90 to a 120-volt wall outlet.

The method of utilizing the apparatus 10 may be achieved by performing the following steps: using the control panel 50 to fill the chair assembly 20 with compressed air by motioning at least one (1) toggle switch 54, 56, 58 upon the control panel 50 to a "FILL" position; pushing and holding the chair inflate switch 56 to the "FILL" position for a period of time to start the air compressor 80 and inflate the seat 22, back rest 24, head rest 26, and arm 30, 32 portions in a coincidental manner; releasing said chair inflate switch 56 upon obtaining a desired firmness within said portions 22, 24, 26, 30, 32; pressing, holding, and releasing the foot rest inflate switch 58 in like manner to inflate the foot rest 28; pressing, holding, and releasing the recline switch 54 in like manner to inflate the internal recline bladder 36 until obtaining a desired reclining angle of the back rest 24; pushing the switches 54, 56, 58 individually to respective "VENT" positions as needed to allow a portion of compressed air to be exhausted, if needed, until obtaining a desired firmness or a desired reclined angle; sitting or laying upon the chair assembly 20; using said toggle switches 54, 56, 58 to fine-tune firmness and form characteristics of the apparatus 10 as needed to obtain a desired comfort level; and, utilizing the apparatus 10 for rest, sleep, or lounging, in a normal manner.

The method of deflating and transporting the apparatus 10 may be achieved by performing the following steps: bodily exiting the chair assembly 20; pushing the switches 54, 56, 58 to the respective "VENT" positions as needed to enable deflation of all chamber portions of the chair assembly 20; gently squeezing the chair assembly 20 during the deflation process to enable complete evacuation of the contained air; releasing the toggle switches 54, 56, 58; unplugging the power cord 90 from the wall outlet; rolling up the chair assembly 20 into a compact form; inserting the rolled-up chair assembly 20 and air compressor 80 into the carrying case 120; closing the zipper portion 128 of the carrying case 120 using the zipper puller portion 130; and, transporting the apparatus 10 to another location for additional use, or to a suitable storage location.

The user 110 may alternately utilize the remote controller 100, if desired, to perform the previously described inflating and deflating processes by pressing functionally corresponding push button portions 104 of the remote controller 100.

The apparatus 10 is further envisioned as being particularly useful for those users 110 suffering from sleep apnea, neck pain, back pain, and other ailments which prevent sleeping on a conventional air mattress.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. An inflatable reclining chair assembly comprising:

an inflatable structure including a seat, a foot rest and a recline bladder isolated from each other;

a control panel attached to said inflatable structure, comprising:

a recline inflate switch, a chair inflate switch, and a foot rest inflate switch selectively adjusting a position of said recline bladder, said seat and said foot rest respectively; and a vent exhaust in fluid communication with said recline bladder, said seat and said foot rest respectively;

a valve module attached said inflatable structure and in communication with said control panel, comprising:

a pneumatic distribution manifold;

a foot rest valve, a chair valve, and a recline valve in fluid communication with said pneumatic distribution manifold respectively and in electrical communication with said recline inflate switch, said chair inflate switch and said foot rest inflate switch; and, a RF receiver module in wireless communication with a remote controller as well as said foot rest valve, said chair valve and said recline valve respectively;

an air compressor located adjacent to said inflatable structure and having an air supply hose connected to said valve module; and, a plurality of air distribution hoses independently conveying compressed air from said valve module to said foot rest and said recline bladder respectively;

wherein said valve module is in pneumatic and electrical communication with said air compressor and said control panel respectively; and, wherein each of said seat, said foot rest and said recline bladder are selectively and independently inflated.

2. The inflatable reclining chair assembly of claim 1, wherein said inflatable structure further comprises: a back rest, a head rest, and first and second arm rests in fluid communication with each other as well as being isolated from said foot rest and said recline bladder respectively.

3. The inflatable reclining chair assembly of claim 1, wherein said inflatable structure further comprises: a storage pouch integrated into a forward-facing surface of said seat portion, said foot rest being contained within said storage pouch when said foot rest portion is completely deflated.

4. The inflatable reclining chair assembly of claim 2, wherein said inflatable reclining chair assembly further comprises:

a plurality of air ports located along an interior wall portion of said inflatable structure and thereby enabling air to freely pass between said seat, said back rest, said head rest, and said first and second arm rests;

wherein said air ports are connected to said air distribution hoses and said foot rest and said recline bladder respectively.

5. The inflatable reclining chair assembly of claim 1, further comprising:

a carrying case capable of entirely receiving said inflatable structure therein, when said inflatable structure is deflated.

6. An inflatable reclining chair assembly comprising:

an inflatable structure including a seat, a foot rest and a recline bladder isolated from each other;

a control panel attached to said inflatable structure, comprising:

a recline inflate switch, a chair inflate switch, and a foot rest inflate switch selectively adjusting a position of said recline bladder, said seat and said foot rest respectively; and a vent exhaust in fluid communication with said recline bladder, said seat and said foot rest respectively;

a valve module located within said inflatable structure and in communication with said control panel, comprising:

a pneumatic distribution manifold;

a foot rest valve, a chair valve, and a recline valve in fluid communication with said pneumatic distribution manifold respectively and in electrical communication with said recline inflate switch, said chair inflate switch and said foot rest inflate switch; and, a RF receiver module in communication with a remote controller as well as said foot rest valve, said chair valve and said recline valve respectively;

an air compressor located exterior of said inflatable structure and having an air supply hose connected to said valve module; and, a plurality of air distribution hoses independently conveying compressed air from said valve module to said foot rest and said recline bladder respectively;

wherein said valve module is in pneumatic and electrical communication with said air compressor and said control panel respectively; and, wherein each of said seat, said foot rest and said recline bladder are selectively and independently inflated.

7. The inflatable reclining chair assembly of claim 6, wherein said inflatable structure further comprises: a back rest, a head rest, and first and second arm rests in fluid communication with each other as well as being isolated from said foot rest and said recline bladder respectively.

8. The inflatable reclining chair assembly of claim 6, wherein said inflatable structure further comprises: a storage pouch integrated into a forward-facing surface of said seat portion, said foot rest being contained within said storage pouch when said foot rest portion is completely deflated.

9. The inflatable reclining chair assembly of claim 7, wherein said inflatable reclining chair assembly further comprises:

a plurality of air ports located along an interior wall portion of said inflatable structure and thereby enabling air to freely pass between said seat, said back rest, said head rest, and said first and second arm rests;

wherein said air ports are connected to said air distribution hoses and said foot rest and said recline bladder respectively.

10. The inflatable reclining chair assembly of claim 6, further comprising: a carrying case capable of entirely receiving said inflatable structure therein, when said inflatable structure is deflated.

11. A method of utilizing an inflatable reclining chair assembly, said method comprising the chronological steps of:

providing an inflatable structure including a seat, a foot rest and a recline bladder isolated from each other;

providing and attaching a control panel to said inflatable structure, said control panel comprising a recline inflate switch, a chair inflate switch, a foot rest inflate switch selectively adjusting a position of said recline bladder, said seat and said foot rest respectively and, a vent exhaust in fluid communication with said recline bladder, said seat and said foot rest respectively;

providing and locating a valve module within said inflatable structure such that said valve module is in communication with said control panel;

providing and locating an air compressor exterior of said inflatable structure;

providing and connecting an air supply hose to said air compressor and said valve module; and, providing a plurality of air distribution hoses independently conveying compressed air from said internal valve module to said foot rest and said recline bladder respectively;

wherein said valve module is in pneumatic communication with said air compressor via a pneumatic distribution manifold in fluid communication with a foot rest valve, a chair valve, and a recline valve;

wherein said valve module is in electrical communication with said recline inflate switch, said chair inflate switch and said foot rest inflate switch;

wherein said valve module comprises a RF receiver module in wireless communication with a remote controller as well as said foot rest valve, said chair valve and said recline valve; and, wherein each of said seat, said foot rest and said recline bladder are selectively and independently inflated.

* * * * *